US008434388B2

(12) United States Patent
Chaffins

(10) Patent No.: US 8,434,388 B2
(45) Date of Patent: May 7, 2013

(54) INTERCHANGEABLE BOTTLE OPENER WITH BOTTLE CAP RECEPTACLE

(76) Inventor: William Chaffins, Lake Park, FL (US)

( * ) Notice: Subject to any disclaimer, the term of this patent is extended or adjusted under 35 U.S.C. 154(b) by 373 days.

(21) Appl. No.: 12/820,438

(22) Filed: Jun. 22, 2010

(65) Prior Publication Data

US 2010/0319494 A1 Dec. 23, 2010

Related U.S. Application Data

(60) Provisional application No. 61/219,221, filed on Jun. 22, 2009.

(51) Int. Cl.
*B67B 7/44* (2006.01)
*B67B 7/00* (2006.01)

(52) U.S. Cl.
USPC ..... 81/3.08; 81/3.09; 81/3.25

(58) Field of Classification Search ..... 81/3.08, 81/3.09, 3.25, 3.27, 3.29, 3.55; D8/37, 38
See application file for complete search history.

(56) References Cited

U.S. PATENT DOCUMENTS

D269,405 S * 6/1983 Ehrlich ..... D8/37
4,560,344 A 12/1985 Kietaibl
4,580,303 A 4/1986 Henshaw
5,133,233 A 7/1992 Erwin
5,265,501 A * 11/1993 Reyes ..... 81/3.08
D454,037 S 3/2002 Briscoe
D500,648 S 1/2005 Kelleghan
6,851,147 B2 2/2005 Abrahall
D517,881 S 3/2006 Kelleghan
D520,825 S 5/2006 Kelleghan
7,143,666 B1 12/2006 Gutierrez
7,237,292 B1 7/2007 Endres
7,313,983 B1 1/2008 Book
D565,371 S 4/2008 Welch
2005/0035080 A1* 2/2005 Romero ..... 81/3.09
2007/0095171 A1* 5/2007 Gold ..... 81/3.55
2008/0083301 A1 4/2008 Messina
2009/0133537 A1* 5/2009 Uglum ..... 81/3.37
2010/0319494 A1 12/2010 Chaffins

* cited by examiner

*Primary Examiner* — Hadi Shakeri
(74) *Attorney, Agent, or Firm* — McHale & Slavin, P.A.

(57) ABSTRACT

The present invention describes a novelty, mountable bottle opening device configured to display an interchangeable, theme-based display panel upon a vertical surface. The mountable bottle opening device includes a support base structure, an intermediate connecting element, an interchangeable decorative overlay panel, a bottle cap removal device, a bottle cap disposal receptacle, and at least one decorative cover. Many of the elements are interchangeable and provide for displaying unlimited and diverse themes. As the device is used to remove a bottle cap, the user perceives an audio message, visual message and/or mechanical event.

14 Claims, 6 Drawing Sheets

INTERCHANGEABLE BOTTLE OPENER WITH BOTTLE CAP RECEPTACLE

CROSS REFERENCE TO RELATED APPLICATIONS

The present application claims the benefit of priority under 35 U.S.C. §119(e) to U.S. Provisional Patent Application No. 61/219,221, filed Jun. 22, 2009, the contents of which are incorporated herein by reference.

FIELD OF THE INVENTION

This invention relates to a novelty bottle opening device for removal of a bottle cap, and more particularly to a bottle cap removal device with a bottle cap disposal receptacle which can display various theme-based visual and audio messages. The invention includes interchangeable parts which enable the theme-based visual and audio messages to be readily changed.

BACKGROUND OF THE INVENTION

Devices that remove bottle caps from a bottle containing various types of beverages are common tools found in many homes and drinking establishments. Many of these devices are designed to be hand held, allowing the user to quickly and easily remove a bottle cap, thereby placing the contents of the bottle, such as beer or soda, into individual glass serving containers. One of the drawbacks associated with hand held bottle openers is that they are easily misplaced and lost, or are placed in inappropriate locations so that when they are needed they cannot be located. In order to eliminate the possibility of loss of these portable devices, bottle cap openers have been mounted to structures. However, attachments of such devices are often hidden from view because they are not aesthetically pleasing. In addition, bottle openers attached to walls or bar counters can be considered to be a hazard. Since the bottle opener projects from the wall, a user may inadvertently strike the opener as they move about the area, thus increasing the risk of liability of the owner of the establishment.

PRIOR ART

Numerous novelty bottle cap openers are known in the prior art, including design patents in the shape of marine life such as a shark, U.S. D500,648, a dolphin, U.S. D517,881, a fish, U.S. D520,825, or other objects, including a surfboard, U.S. D565,371, or a sailboat, U.S. D454,037. In addition to the ornamental designs, various other patents have been granted covering bottle opening devices. For example, U.S. Pat. No. 4,560,344 discloses a compact apparatus having two components, a cigarette lighter and a bottle opener. The apparatus contains a body to provide a fuel tank, a cigarette lighter, and bottle opener which cooperates with the body at positions spaced sufficiently apart on the body to provide an elongated handle of sufficient length for grip and leverage to operate the bottle opener.

U.S. Pat. No. 4,580,303 discloses a bottle opener and resealer. The bottle opener and resealer are combined into a single unit. The single unit incorporates a head member having both a bottle opening recess and a bottle cap resealing recess. A corkscrew member extends from the head member. The device further includes a removable protective sheath which is located about the corkscrew member when not in use. A stopper for a bottle is mounted about the protective sheath and is used within the neck of a bottle to act as a sealing means. The protective sheath is removable and associated with the head in order to function as a handle to facilitate operation of the corkscrew member.

U.S. Pat. No. 5,133,233 discloses a bottle opening tool having a bottle cap-engaging hook and an end fulcrum bar. The engaging hook and an end fulcrum bar are secured to a rigid back plate which is incorporated into the palm of a glove. The back plate is shaped to conform to the shape of the palm of the wearer's hand. The bottle cap is removed by back of user's hand applying lifting force to glove. The device is constructed such that the entire bottle opening tool member fits within palm of glove, thereby leaving fingers unrestricted to movement both while opening bottles and when not being used to open bottles.

U.S. Pat. No. 6,851,147 discloses a combination money clip and bottle cap opener. The device includes a clip body extending to a bend portion and a clip arm extending back along the clip body from the bend portion. The clip arm contains a spring clip biased against the clip body. The bend portion defines a cap aperture shaped to receive a bottle cap.

U.S. Pat. No. 7,143,666 discloses a finger ring bottle opener and includes a continuous ring band with a finger passage and a finger passage axis. A bar integral with a band palm portion extends from the band distal end and is generally parallel to the finger passage axis. A bottom surface of the bar is a cap top engaging surface. A short shank is integral with the band palm portion and extends radially outward from the band. A prong is integral with the shank and extends forward from the shank. A bottle cap skirt bottom engaging surface is on the prong. When the skirt bottom engaging surface is in engagement with a cap skirt bottom and the bar is engaging the cap top, the cap top surface is substantially parallel to the finger passage axis.

U.S. Pat. No. 7,313,983 discloses a compact, ergonomic, pocket-sized bottle opener having a thin, generally flat body. The bottom edge of the body includes a jaw opening and at least one area for receiving a lifting finger. A plug of resiliently yielding material is mounted in the finger-receiving area to cushion the lifting finger. A hook at the forward end of the jaw opening forms a fulcrum point for engaging the top of the bottle cap. The hook also serves to lift pull-tabs on cans. An opening at the rear of the body holds a key ring. The key ring can be slipped into the opening during assembly by flexing the leg so as to open a slot that separates the distal end of the leg from the body. The cushioning plug mounts over both the distal end of the leg and the lower edge of the body so as to hold the leg in place after the ring has been installed. The two sides of the body form broad, generally flat display surfaces for application of logos, advertising, or other information. The body is preferably formed of strong, molded plastic, with a metal insert being installed in the jaw opening for engaging the edges of bottle caps.

United States Patent Application 2008/0083301 describes an improved removable single housing bottle opener and cap catcher. The device has a hinged bottom door and a door latching means for enabling convenient, sanitary disposal of collected bottle cap. The first part of the door latching mechanism is disposed along at least one edge of the hinged bottom door, and a second part is disposed near the bottom of the single housing wherein the second part is sized and located to mate with the first part.

The above referenced prior art describes various devices which are useful for removing bottle caps from a bottle. However, they fail to describe a bottle opener that can display a variety of theme-based messages. U.S. Pat. No. 7,237,292 discloses a one-piece wearable bottle opener that slips onto a wearer's belt without the aid of special attachments. The opener functions with the use of one hand. The top section is prevented from moving outward due to the tightened belt. The opener detail is located below the belt and creates leverage. The lower plate section prevents the opener from moving inward as it is pressed against the bony hip area of the user, allowing the opener to function. The space above the opener detail, and between the belt attachment details, is used for advertising of related products, festivals, artwork and such. While the '292 patent discloses advertising of related products, the message to be displayed is limited. Moreover, the type of message is fixed in place, and therefore the user can not change the message displayed without replacing the entire device. Therefore, what is needed is a novelty, theme-based bottle opener and bottle cap disposal receptacle which is capable of displaying interchangeable, theme-based messages.

SUMMARY OF THE INVENTION

The present invention describes a novelty, theme-based bottle opener for removal of a bottle cap which is attached to a bottle. Additionally, the device provides for a centralized storage area for the bottle caps that have been removed. The device contains several interchangeable elements that can be used to display diverse and unlimited themes. Either hanging from a structure or in use, or when used to remove a bottle cap from a bottle, the user or other third parties perceive an audio message, visual message and/or mechanical event which correlates to the overall theme-based appearance of the device.

The mountable bottle opening device configured to display an interchangeable, theme based display panel upon a vertical surface according to the instant invention comprises a support base structure which is mountable to a vertical surface. Coupled to the support base is an interchangeable decorative overlay structure. The front surface of the interchangeable decorative overlay structure contains theme-based indicia. As used herein, theme-based is used to describe any symbols, graphics, pictures, colors, wordings, sounds, or other types of artistic representations which embody or is associated with one or more subject matters. Coupled to the support base structure is a bottle cap removal device constructed and arranged to receive a bottle having a bottle cap. Additionally, a bottle cap disposal receptacle which is aligned with the bottle cap opening element is secured to the support base structure. To enhance the overall appearance, the device includes at least one decorative cover, including a first decorative cover constructed and arranged to secure to the bottle cap opening element and a second decorative cover constructed and arranged to secure to the bottle cap receiving receptacle. In order to provide audio and/or visual displays, the mountable bottle opening device includes a control panel coupled to a power supply source and to a sensory display device and/or sensor device.

In an alternative embodiment, the mountable bottle opening device which is configured to display an interchangeable, theme based display panel upon a vertical surface comprises a support base structure, and intermediate panel, and an interchangeable decorative overlay panel. The support base structure is constructed and arranged to have a top wall and a bottom wall. Secured to the top wall and the bottom wall is a pair of side walls. The support base structure further includes a back surface which is mountable to a vertical surface, and a front surface. The intermediate panel has a top wall and a bottom wall which are secured to a pair of side walls. The intermediate panel further contains a back surface which is coupled to the support base structure.

The mountable bottle opening device of the instant invention further includes an interchangeable decorative overlay panel having a top wall and a bottom wall. A pair of side walls is secured to the top and bottom walls. The back surface of the interchangeable decorative overlay panel is removably coupled to the intermediate panel while the front surface contains theme-based decorative indicia. Attached to the intermediate panel is a bottle cap removal device. Secured to the support base is a bottle cap disposal receptacle which is aligned with the bottle cap removal device such that when a bottle cap from a bottle head is inserted within the bottle cap removal device and a force is applied to remove the bottle cap, the displaced bottle cap falls into the bottle cap receiving receptacle. The mountable bottle opening device preferably includes a first decorative cover secured to the bottle cap removal device and a second decorative cover constructed and arranged to decoratively enclose the bottle cap disposal receptacle. A control panel coupled to a power source and to a sensor and/or a sensory display device provides visual and audio display capability.

Accordingly, it is an objective of the instant invention to provide a novelty bottle opening device that removes a bottle cap secured to a bottle.

It is a further objective of the instant invention to provide a novelty bottle opening device that removes a bottle cap secured to a bottle which includes a bottle cap disposal receptacle.

It is yet another objective of the instant invention to provide a novelty bottle opening device that removes a bottle cap secured to a bottle that displays a diversity of theme-based messages.

It is a still further objective of the invention to provide a novelty bottle opening device that removes a bottle cap secured to a bottle having interchangeable elements that displays a diversity of theme-based visual appearances.

It is a further objective of the invention to provide a novelty bottle opening device that removes a bottle cap secured to a bottle having interchangeable elements that provide for theme-based audio messages.

It is yet another objective of the invention to provide a novelty bottle opening device that removes a bottle cap secured to a bottle having an interchangeable decorative overlay panel containing theme-based indicia.

It is a still further objective of the invention to provide a novelty bottle opening device that removes a bottle cap secured to a bottle which displays one or more theme-based visual messages, audio messages, and mechanical events.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
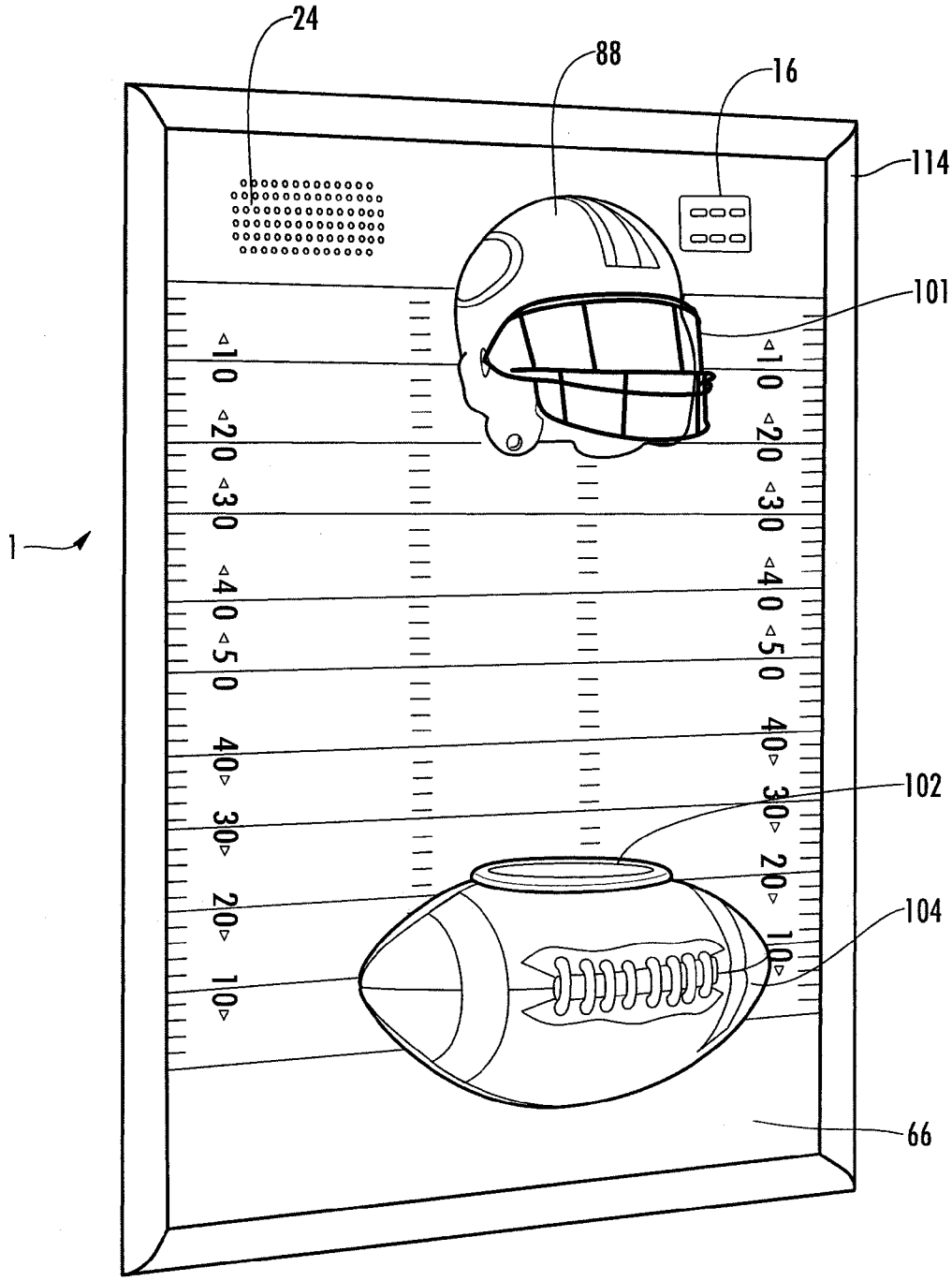
FIG. 1 is a front perspective view of a preferred embodiment of the instant invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

Figure 2:
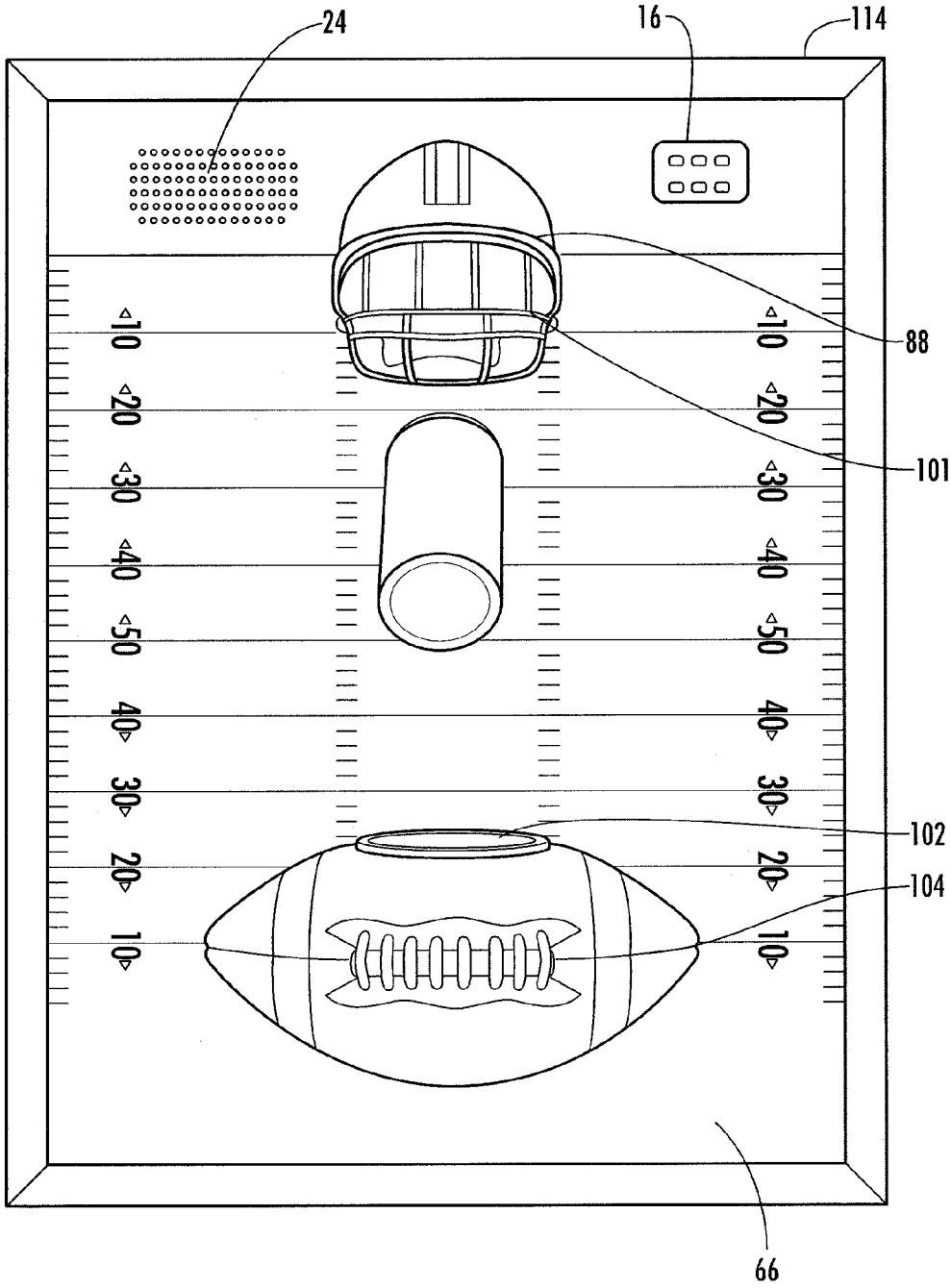
FIG. 2 is a front view of the preferred embodiment of the instant invention illustrated in FIG. 1.

The present invention is described with references to FIGS. 1-5, in which similar reference characters denote similar elements throughout the several views. The mountable bottle opening device with a bottle cap disposal receptacle configured to display an interchangeable, theme-based display panel 1 comprises a support base structure 2, an intermediate connecting element 30, an interchangeable decorative overlay element 66, a bottle cap removal device 52, a bottle cap disposal receptacle 102, and interchangeable coverings 88 and 104. Referring to FIG. 1, mountable bottle opening device with a bottle cap disposal receptacle configured to display an interchangeable, theme-based display panel is illustrated as having a decorative overly in the form of a football field. A football helmet covers a bottle cap removal device and is fastened to the structural body of the invention. A bottle cap disposal receptacle is fastened to the structural element of the invention in a location below the bottle cap removal device and is aligned in such a manner that removal of the bottle cap from a bottle results in the removed cap falling into and being stored within the receptacle. In an illustrative embodiment, the bottle cap disposal receptacle is covered by a football casing. FIG. 2 illustrates placement of a glass beverage bottle into the bottle cap removal device prior to removal of the cap from the bottle.

While FIGS. 1 and 2 show an illustrative embodiment of the instant invention including a football helmet, football casing covering the bottle cap disposal receptacle, and a simulated football field covering the support base structure, many different sports and other items representing different themes are possible. The decorative overlays are interchangeable. For instance, if a user desires to mount a specific college or professional team onto the mountable bottle opening device, the user simply attaches the helmet of the desired team to the invention. If the user wishes to change themes, they simply remove the football field decorative overly and replace it with another one, such as, but not limited to, a baseball field, basketball field, hockey rink, golf course, or race car track. For example, for race car enthusiasts, the decorative overly could be designed to have a NASCAR (National Association for Stock Car Auto Racing) themed backdrop, such as a race track, a specific race track venue, a picture of a famous driver, or other symbols of the racing car industry such as specific race cars, checkered-victory flags, or the like. The bottle cap removal device cover and the bottle cap disposal receptacle cover, therefore, could be a race car, a stirring wheel, or driving gauges such as a speedometer and/or gasoline indicator. For individuals not desiring a sports-related theme, the instant invention can be adapted to accommodate such needs. A country-western theme can be depicted by combining a bull-riding decorative overlay with a cowboy hat, belt buckle, or boot as either the bottle cap removal device or bottle cap disposal receptacle cover.

Figure 3:
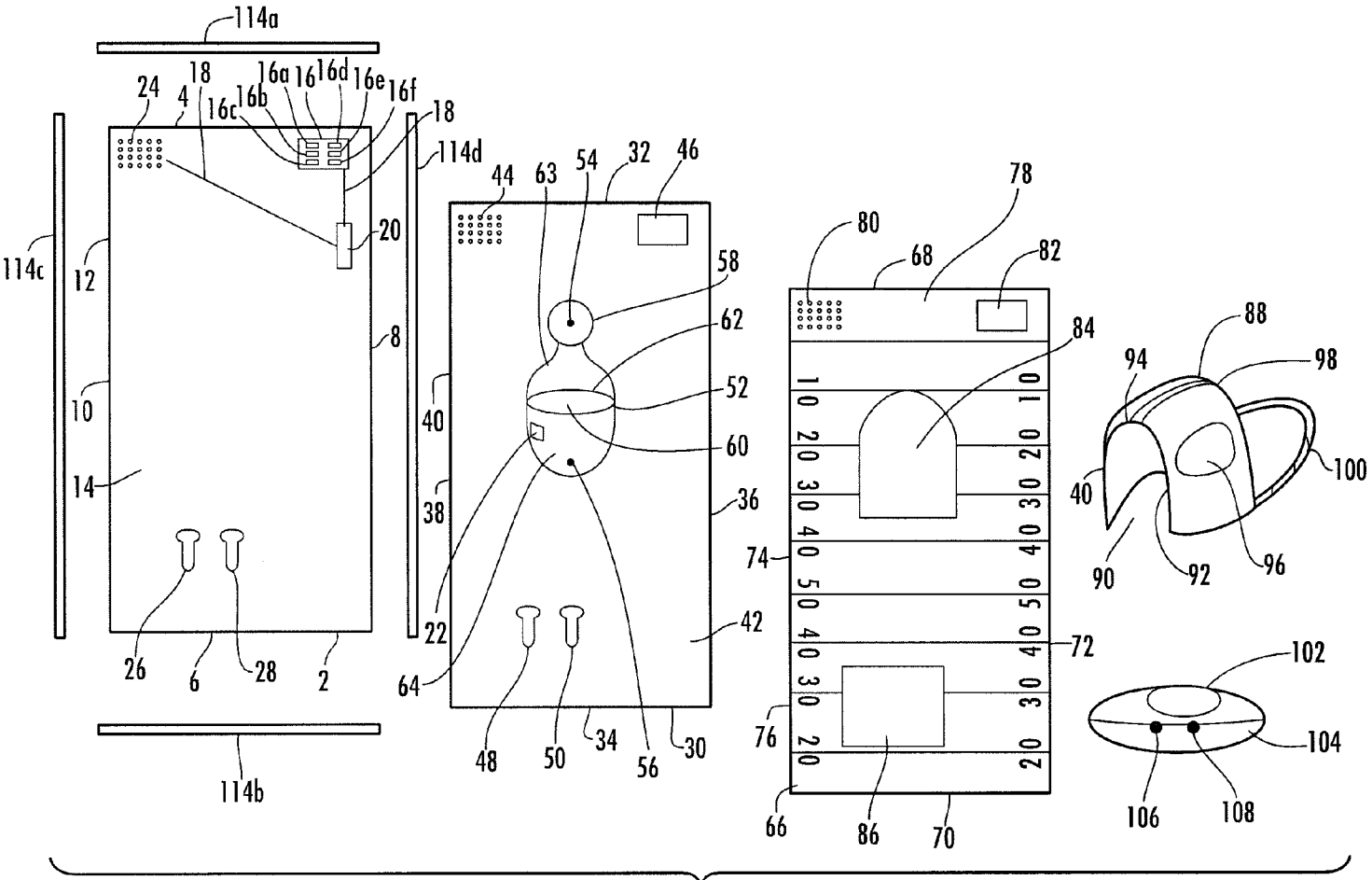
FIG. 3 is an exploded view of the instant invention.

FIG. 3 is an exploded view of the mountable bottle opening device with the bottle cap disposal receptacle configured to display an interchangeable, theme-based display panel of FIGS. 1 and 2. The support base structure 2 provides structural integrity and is made of any material, such as wood, plastic, metal, or the like, that can support the combinations of all elements of the instant invention. The support base structure, illustrated as a panel 2, has a top wall 4 and a bottom wall 6. In a preferred embodiment, the top wall 4 and the bottom wall 6 are equally sized and in a parallel arrangement. Secured to the top wall 4 and the bottom wall 6 is a pair of side walls, 8 and 10. The side walls 8 and 10 are preferably equally sized and in parallel arrangement. The support base structure 2 contains a back surface 12 which is mountable to a vertical surface, such as a wall or pole, and a front surface 14. The control panel 16 is mounted on the support base structure 2 and contains multiple buttons correlating to various functions. Button 16*a*, for example, can be used to place the instant invention in the "on" or "off" position. Electrical circuitry 18 connects the control panel 16 to a power supply source, 20, which includes a battery or an electrical outlet plug. The control panel 16 may also be electrically coupled to a sensor (described later) 22 and/or sensory display device 24, such as a speaker for audio notification of pre-recorded messages, lights, or a message board for illuminated displays of flashing lights, words, symbols, or combinations thereof. Control of such displays could be accomplished through buttons 16*b*-16*f*, thereby allowing the user the ability to set the device to display specific pre-recorded audio messages or pre-set visual messages. For instance, pressing button 16*b* would set the instant invention in a mode which, at the appropriate time, would display a plurality of lights in the shape of the word "TOUCHDOWN" from the message board 116, see FIG. 5. The message board 116 may be, for example, a plurality of free-standing clear or colored lights, an LED flashing reader board, or a rotating, scroll-type board, with or without lights. Selecting button 16*c* would deploy a different message, such as "GO BEARS" or "GO LONGHORNS." Button 16*f* could be used to record personal messages. The support base structure 2 also contains apertures, 26 and 28, to provide attachment of the bottle cap disposal receptacle to the support base structure. As illustrated, apertures 26 and 28 are keyhole shaped, which allow an item to be inserted into the circular section of the keyhole and then slid down the cylindrical portion to lock the item in place. However, any means of attaching and holding the disposal receptacle to support base structure 2 known to one of skill in the art is contemplated in the instant invention.

Attached to the support base structure 2 is an intermediate connecting element 30. The intermediate connecting element 30 is constructed to fit within support base structure 2 and designed to provide interchangeable, removable connection between the decorative overlay 66 and support base structure 2. The intermediate connecting element 30 comprises a top wall 32 and a bottom wall 34. In a particular embodiment, the top wall 32 and the bottom wall 34 are equally sized and in parallel arrangement. Secured to the top wall 32 and the bottom wall 34 is a pair of side walls 36 and 38. The side walls 36 and 38 are equally sized and in parallel arrangement. The intermediate connecting element 30 further comprises a back surface 40 which is coupled to the support base structure, and a front surface 42. In a particular embodiment, the intermediate connecting element 30 is a plate or panel constructed of a metal material so as to have a magnetic interconnection with the decorative overlay 66. However, the intermediate connecting element 30 can be made from any material or be any fastening method that would allow removable attachment to the decorative overlay, including but not limited to VELCRO®, buttons, small magnets, or the like. In another embodiment, the mountable bottle opening device with bottle cap disposal receptacle configured to display an interchangeable, theme based display panel 1, the intermediate connecting element 30 is omitted and the support base structure 2 functions as the intermediate connecting element by being constructed of a material, either partially or in full, which allows for direct, removable interconnection with the decorative overlay. The intermediate connecting element 30 contains several apertures 44, 46, 48, and 50, corresponding to the location of several elements associated with the support base structure 2. The location of aperture 44 on the intermediate connecting element is constructed to correspond to the sensory display device 24 which is connected to the support base structure 2. Aperture 46 is positioned on the intermediate connecting element to correspond with the control panel 16. Keyhole openings 48 and 50 correspond to the location of the keyhole openings 26 and 28 respectively, located on support base structure 2.

Attached to the intermediate connecting element 30 is a bottle cap removal device 52. The bottle cap removal device 52 attaches to the intermediate connecting element 30 via fastening elements, 54 and 56, such as pins, screws, screws and nuts, or the like. Fastening element 54 is inserted into the knob-like structure 58 of the bottle cap removal device 52. A second fastening element 56 is inserted into the bottom portion of the bottle cap removal device 52. The bottle cap removal device 52 contains an aperture 60 for insertion of a bottle containing a bottle cap. The bottle cap is removed by insertion of the cap into the aperture 60 and contact with edge 62 associated with aperture 60. Once in the correct position, a force is exerted and the bottle cap is removed. The bottle cap removal device 52 may contain a sensor 22, including but not limited to sensors measuring temperature, distance, motion, light, presence or absence of an object, which can be programmed to trigger a pre-recorded message, light display, or mechanical events in the form of moving parts. In a preferred embodiment, the mountable bottle opening device with bottle cap disposal receptacle configured to display an interchangeable, theme-based display panel utilizes a motion sensor. The top portion of the bottle cap removal device 52 may include an angled, convex, or planar surface 63 which connects knob 58 with opening 52. The bottom portion of the bottle cap removal device 52 is designed to include a flat, rounded, angled, tubular, convex, or concave shaped portion 64 which aids in directing the removed bottle cap into the receptacle. Alternatively, for an embodiment that does not include the intermediate connecting element 30, the bottle cap removal device 52 is attached directly to the support base structure 2.

Coupled directly to the support structure 2 or the intermediate connecting element 30 is an interchangeable decorative overlay structure 66. The interchangeable decorative overlay structure, illustrated as a panel, comprises a top wall 68 and a bottom wall 70. In a preferred embodiment, the top wall 68 and the bottom wall 70 are equally sized and in parallel arrangement. Secured to the top wall 68 and the bottom wall 70 are a pair of side walls 72 and 74. Preferably, the side walls 72 and 74 are equally sized and in parallel arrangement. The interchangeable decorative overlay panel 66 includes a back surface 76 which is removably coupled to either the support base structure 2 or the intermediate panel 30. The front surface 78 of the interchangeable decorative overlay panel 66 contains theme based decorative indicia, such as but not limited to symbols, words, or pictures. The interchangeable decorative overlay panel 66 contains a plurality of apertures 80, 82, 84, and 86. Location of aperture 80 within the interchangeable decorative overlay panel 66 corresponds to the positioning of the aperture 44 of the intermediate connecting element 30 or the sensory display device 24 attached to the support base structure 2. Positioning of the aperture 82 corresponds to the location of the aperture 46 of the intermediate connecting element 30 and/or the control unit 16 of the support base structure 2. The aperture 84 is positioned on the interchangeable decorative overlay panel 66 to correspond to the location of the bottle cap removal device 52. The interchangeable decorative overlay panel can be made of, or contain, any material which provides for attachment to either the intermediate connecting element or the support base structure itself, such as tape, VELCRO, or snaps, or buttons. In a preferred embodiment, the interchangeable decorative overlay panel 66 is made of magnetic material which magnetically couples to the support base structure and/or the intermediate connecting element. Although the interchangeable decorative overlay panel illustrates a sports-based theme, such as a football field, the decorative overlay is not limited to such themes and can be designed to include any illustration.

Attached to the bottle cap removal device 52 is an ornamental bottle cap removal device cover 88. As illustrated in FIG. 2, the ornamental bottle cap removal device cover 88 is a football helmet. In a particular embodiment, part of the back of the football helmet has been removed to provide an attachment capability to the bottle cap removal device 52. With such an arrangement, the ornamental bottle cap removal device cover 88 is placed over and ultimately rests upon the bottle cap removal device 52 by sliding the back-end 90 over the bottle cap removal device 52 such that sides 90 and 92 are placed along the surface of the bottle cap removal device 52 and the curved portion 94 rests on knob-structure 58. However, any known mechanism of attachment that provides easy removal and attachment known to one of skill in the art, such as but not limited to, buttons, hook and loop type fasteners, such as VELCRO®, captive fasteners, latches, or the like is contemplated in the invention. The ornamental bottle cap removal device cover in the form of a football helmet 88 may include items such as a team logo 96, team color stripes 98, face guard 100, or face protector shield 101, see FIG. 1 or 2.

Figure 4A:
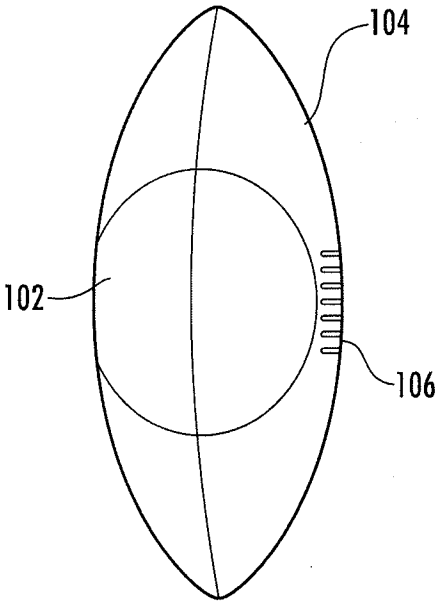
FIG. 4A is a top view of the bottle cap disposal receptacle and decorative covering of the instant invention.
Figure 4B:
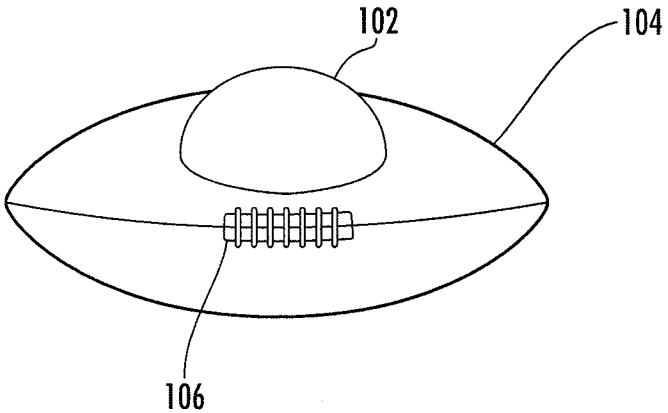
FIG. 4B is a front plane view of the bottle cap disposal receptacle and decorative covering of the instant invention.
Figure 4C:
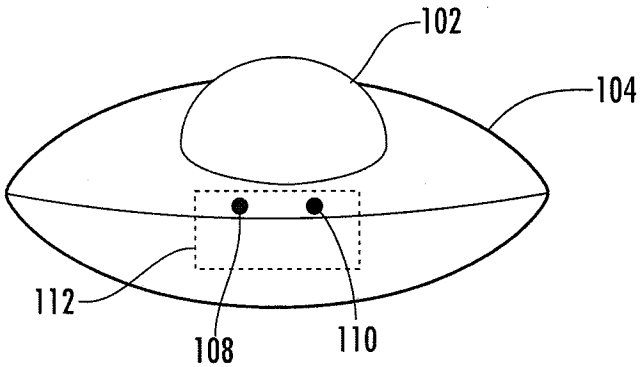
FIG. 4C is a rear plane view of the bottle cap disposal receptacle and decorative covering of the instant invention.
Figure 5:
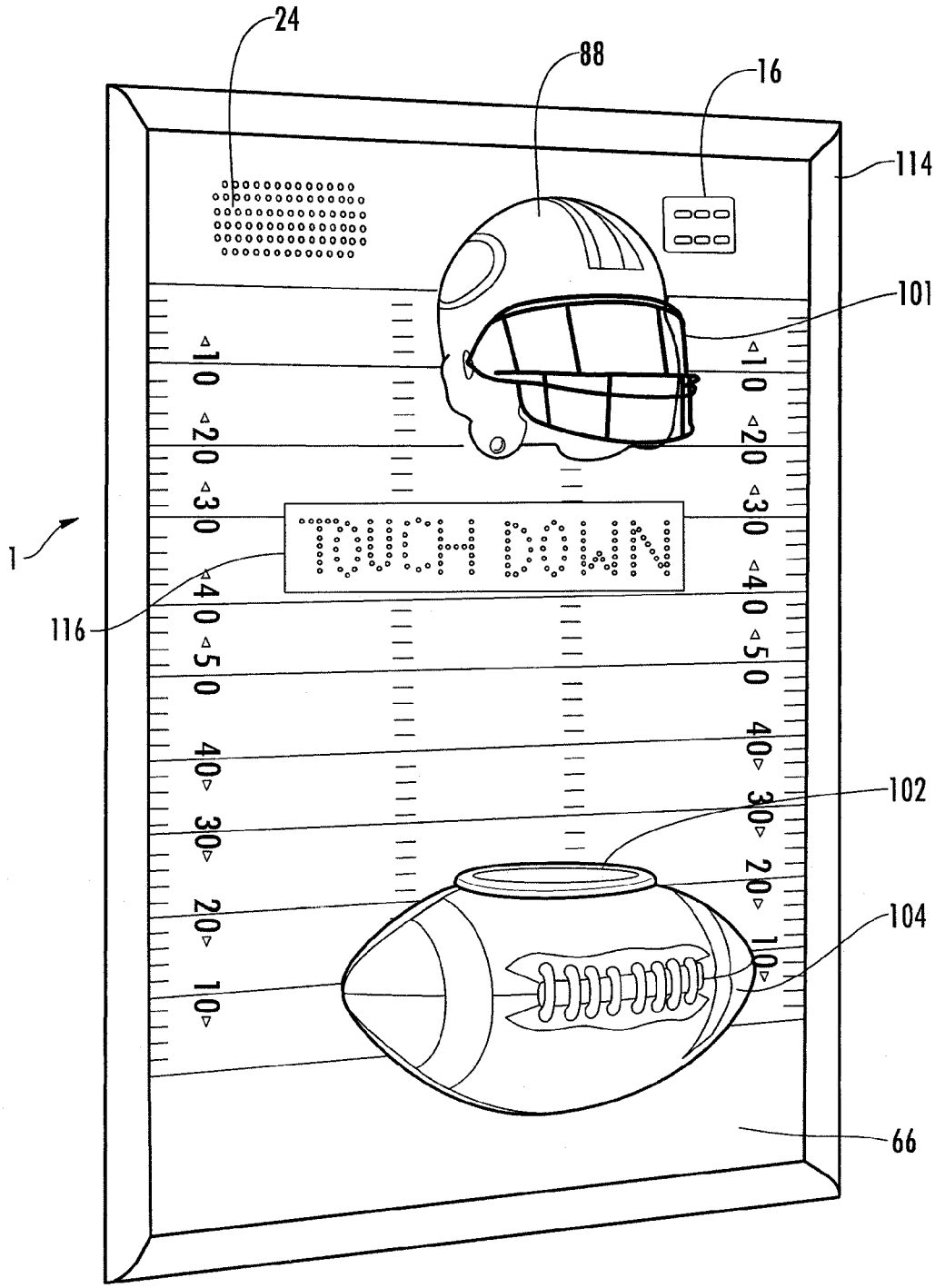
FIG. 5 is a particular embodiment of the instant invention illustrating the use of a message board for visually conveying text messages.

Attached to the mountable bottle opening device with a bottle cap disposal receptacle configured to display an interchangeable, theme-based display panel 1 is a bottle cap disposal receptacle 102. To enhance the visual appearance, the disposal receptacle 102 is enclosed within an ornamental bottle cap disposal receptacle cover 104. Cover 104 is illustrated in the shape of a football, see FIG. 4A. FIG. 4B illustrates a front side view in which the ornamental bottle cap disposal receptacle cover 104 contains ornamental designs or patterns, such as a football gripping 106, to aid in enhancing the visual experience. FIG. 4C is a rear, side view, illustrating insertion of hooking elements 108 and 110. The ornamental bottle cap disposal receptacle cover 104 may also contain a structure 112 such as a metal plate, wood block, plastic block, or the like, to provide a substrate for which hooking elements 108 and 110 can be inserted within and attached to. Hooking elements 108 and 110 may be any type of fastening or connecting device, such as, but not limited to, pins, screws, screws with a nut, hooks, or the like which correspond to apertures 26 and 28 and/or 48 and 50 respectively. Depending on the desired theme, cover 104 can take on various shapes.

Not only does a user enjoy an audio pleasure associated with the device, but the interchangeable parts of the instant invention provide unlimited diversity in visual related themes, thereby aiding in image enhancement. Various novelty and inventive aspects of the instant invention are illustrated in the following example. Users of the instant invention tend to cater to sports fans and often desire to enhance their patron's/friend's experience by decorating the bar/home in a sports-related theme. For example, during the autumn football season, restaurants, saloons, or homeowners decorate their establishment with sports paraphernalia associated with a favorite football team and their team colors and mascot. For aesthetic enhancement, the mountable bottle opening device with bottle cap disposal receptacle configured to display an interchangeable, theme-based display panel 1 includes a framing 114, made up of 114*a*-114*d*, and is mounted to a vertical surface, such as a wall behind a bar of a public restaurant, saloon, or private entertainment area of a house. In order to accommodate specific crowds, users of the instant invention simply hang the mountable bottle opening device with a specific interchangeable decorative overlay panel and ornamental bottle cap removal device cover 88 in a desired area. As a patron orders a drink requiring removal of a bottle cap, the user simply places the bottle into aperture 60 of the bottle cap removal device 52. As the bottle is placed into the area or upon removal of the bottle cap, the mountable bottle opening device with a bottle cap disposal receptacle configured to display an interchangeable, theme-based display panel 1 displays some type of entertaining visual display or audio action. Such entertaining visual display or audio action may include audio (pre-recorded message), visual (Light Emitting Devices (LED) displays or message boards conveying illuminated text images, words, symbols, clear or colored lights) or mechanical (moving parts) displays, or combinations thereof. As the bottle is removed from the device and a message is displayed, the bottle cap that was removed simply falls into the bottle cap disposal receptacle 102. In addition to team loyalty and good-will, the instant invention provides for a cleaner area as there is no need to retrieve or clean up bottle caps that have fallen to the floor. Instead, once the receptacle 102 fills with bottle caps, simply removing it and emptying the bottle caps into a secondary trash receptacle is all that is required to prevent a mess from developing on the floor. If for some reason the user needs to accommodate a different set of patrons/friends, i.e. fans of another football team or switch from professional football to college football, the user simply replaces football helmet 88 with that of another helmet having the desired football team. Additionally, the user can also display a new audio message by activating a different control command button, i.e. 16*c*, of control panel 16. As sports seasons change, users interchange the decorative overlay, bottle cap removal device cover, and bottle cap disposal receptacle cover to match the sporting event, such as basketball in the winter or baseball in the summer.

Figure 6:
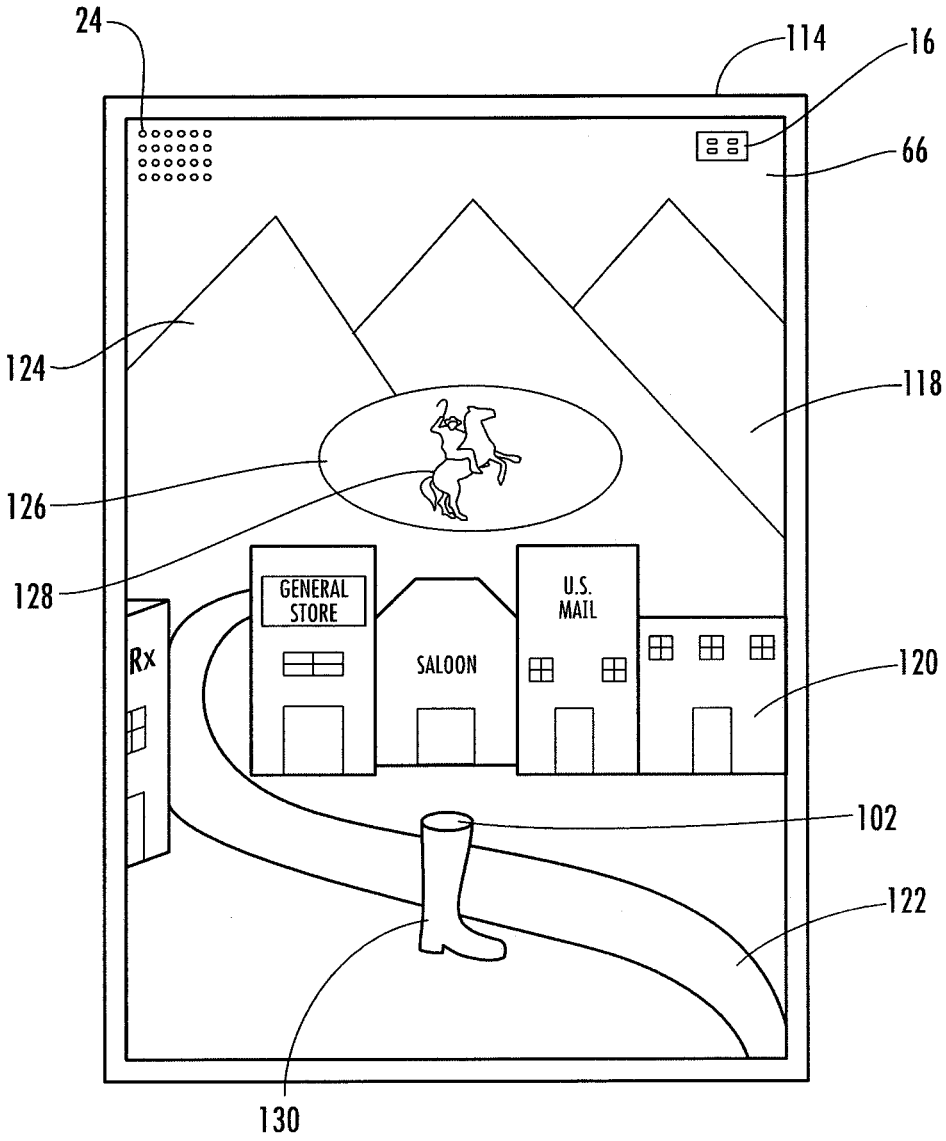
FIG. 6 is particular embodiment of the instant invention illustrating the interchangeable decorative overlay structure having a country/western base theme.

FIG. 6 is a particular embodiment of the mountable bottle opening device with a bottle cap disposal receptacle configured to display an interchangeable, theme-based display panel 1 displaying a country/western theme. This particular embodiment is constructed and arranged in a same manner as described previously, including having a support base structure, an intermediate structure, an interchangeable decorative overlay structure, a bottle cap removal device, a bottle cap disposal receptacle constructed and arranged to receive a bottle cap, and at least one decorative cover. As illustrated, the decorative overlay 66 contains a western theme 118 having a picture of on old-west town with town buildings 120, main street 122, and mountains 124 as a backdrop. The scene depicted in FIG. 6 is illustrative only, as any symbols, graphics, colors, and words, including pictures of cowboys, cowboy hats, cactus, or sun sets which express a country/western theme can be use. Attached to the bottle cap removal device is an ornamental bottle cap removal device cover 126 in the form of a belt-buckle. The belt-buckle 126 contains decoration 128, a picture of a cowboy riding a horse. A bottle cap disposal receptacle cover 130 in the form of a cowboy boot encloses the bottle cap disposal receptacle 102.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A mountable bottle opening device configured to display an interchangeable, theme based display panel upon a vertical surface comprising:

a support base structure, said support base structure having a top wall and a bottom wall, said top wall and said bottom wall being equally sized and in parallel arrangement, a pair of side walls, said side walls being equally sized and in parallel arrangement and coupled to said top wall and said bottom wall, a back surface, said back surface mountable to a vertical surface, and a front surface;

an intermediate connecting element, said intermediate connecting element having a top wall and a bottom wall, said top wall and said bottom wall being equally sized and in parallel arrangement, a pair of side walls, said side walls being equally sized and in parallel arrangement and coupled to said top wall and said bottom wall; a back surface, said back surface coupled to said support base structure, and a front surface;

an interchangeable decorative overlay structure, said decorative overlay structure having a top wall and a bottom wall, said top wall and said bottom wall being equally sized and in parallel arrangement, a pair of side walls, said side walls being equally sized and in parallel arrangement and coupled to said top wall and said bottom wall, a back surface, said back surface removably coupled to said intermediate connecting element, and a front surface containing theme-based indicia;

a bottle cap removal device coupled to said intermediate connecting element;

a bottle cap disposal receptacle secured to said support base structure, said bottle cap receiving receptacle aligned with said bottle cap removal device, wherein removal of a bottle cap from a bottle head inserted within said bottle cap removal device results in said bottle cap disposal receptacle catching said removed bottle cap; and at least one decorative cover.

2. The mountable bottle opening device configured to display an interchangeable, theme-based display panel upon a vertical surface according to claim 1 wherein said at least one decorative cover includes a first cover constructed and arranged to be secured to said bottle cap removal device.

3. The mountable bottle opening device configured to display an interchangeable, theme-based display panel upon a vertical surface according to claim 2 further includes a second cover constructed and arranged to be secured to said bottle cap disposal receptacle.

4. The mountable bottle opening device configured to display an interchangeable, theme-based display panel upon a vertical surface according to claim 1 wherein said support base structure further includes a control panel coupled to a power supply source and to a sensory display device.

5. The mountable bottle opening device configured to display an interchangeable, theme-based display panel upon a vertical surface according to claim 4 wherein said support base structure further includes a sensor electrically coupled to said control panel, to said sensory display device, or combinations thereof.

6. The mountable bottle opening device configured to display an interchangeable, theme-based display panel upon a vertical surface according to claim 5 wherein said sensory display device displays an audio message, a visual message, or combinations thereof.

7. The mountable bottle opening device configured to display an interchangeable, theme-based display panel upon a vertical surface according to claim 1 wherein said indicia is words, symbols, pictures or combinations thereof.

8. The mountable bottle opening device configured to display an interchangeable, theme-based display panel upon a vertical surface according to claim 1 wherein said intermediate connecting element and said interchangeable decorative overlay structure are magnetically coupled.

9. A mountable bottle opening device configured to display an interchangeable, theme-based display panel upon a vertical surface comprising:

a support base structure, said support base structure having a top wall and a bottom wall, said top wall and said bottom wall being equally sized and in parallel arrangement, a pair of side walls, said side walls being equally sized and in parallel arrangement and coupled to said top wall and said bottom wall, a back surface, said back surface mountable to a vertical surface, and a front surface;

an intermediate panel, said intermediate panel having a top wall and a bottom wall, said top wall and said bottom wall being equally sized and in parallel arrangement, a pair of side walls, said side walls being equally sized and in parallel arrangement and coupled to said top wall and said bottom wall, a back surface, said back surface coupled to said support base structure, and a front surface;

an interchangeable decorative overlay panel, said decorative overlay panel having a top wall and a bottom wall, said top wall and said bottom wall being equally sized and in parallel arrangement, a pair of side walls, said side walls being equally sized and in parallel arrangement and coupled to said top wall and said bottom wall; a back surface, said back surface removably coupled to said intermediate panel, and a front surface containing theme based decorative indicia;

a bottle cap removal device constructed and arranged to receive and remove a bottle cap from a bottle, said bottle cap removal device coupled to said intermediate panel;

a bottle cap disposal receptacle secured to said support base structure, said bottle cap receiving receptacle aligned with said bottle cap removal device, wherein removal of a bottle cap from a bottle head inserted within said bottle cap removal device results in said bottle cap disposal receptacle catching said removed bottle cap;

an ornamental bottle cap removal device cover secured to said bottle cap removal device and constructed and arranged to receive bottle cap removal device while allowing insertion of a bottle head containing a bottle cap attached thereto;

an ornamental bottle cap disposal receptacle cover constructed and arranged to be secured to said bottle cap disposal receptacle; and a control panel, said control panel coupled to a power source.

10. The mountable bottle opening device configured to display an interchangeable, theme-based display panel upon a vertical surface according to claim 9 wherein said support base structure further includes a sensory display device electrically coupled to said control panel.

11. The mountable bottle opening device configured to display an interchangeable, theme-based display panel upon a vertical surface according to claim 10 wherein said support base structure further includes a sensor electrically coupled to said control panel, said sensory display device, or combinations thereof.

12. The mountable bottle opening device configured to display an interchangeable, theme based display panel upon a vertical surface according to claim 11 wherein said visual message is a message board, said message board conveying illuminated text images, words, symbols, lights, or combinations thereof.

13. The mountable bottle opening device configured to display an interchangeable, theme based display panel upon a vertical surface according to claim 11 wherein said intermediate panel and said interchangeable decorative overlay panel are magnetically coupled.

14. The mountable bottle opening device configured to display an interchangeable, theme based display panel upon a vertical surface according to claim 10 wherein said sensory display device displays an audio message, a visual message, or combinations thereof.

* * * * *